US006422338B1

(12) United States Patent
Menzel et al.

(10) Patent No.: US 6,422,338 B1
(45) Date of Patent: Jul. 23, 2002

(54) EXHAUST GAS MUFFLER FOR INTERNAL COMBUSTION ENGINES

(75) Inventors: Johannes Menzel; Bernhard Dürr, both of Stuttgart; Gerd Wöllhaf, Weinstadt, all of (DE)

(73) Assignee: Andreas Stihl AG & Co. (DE)

( * ) Notice: Subject to any disclaimer, the term of this patent is extended or adjusted under 35 U.S.C. 154(b) by 4 days.

(21) Appl. No.: 09/586,417

(22) Filed: Jun. 1, 2000

(30) Foreign Application Priority Data

Jun. 1, 1999 (DE) ..... 199 24 888

(51) Int. Cl.[7] ..... F01N 3/00

(52) U.S. Cl. ..... 181/230; 181/240; 181/231; 181/269; 181/282; 181/283

(58) Field of Search ..... 181/230, 240, 181/231, 262, 259, 269, 272, 282, 283

(56) References Cited

U.S. PATENT DOCUMENTS 4,324,314 A * 4/1982 Beach et al. ..... 181/230
4,370,855 A 2/1983 Tuggle ..... 60/317
4,628,689 A * 12/1986 Jourdan ..... 60/295
5,883,342 A * 3/1999 Wolpert ..... 181/230
5,996,732 A * 12/1999 Burger et al. ..... 181/230

FOREIGN PATENT DOCUMENTS

DE DE 25 39 516 9/1975
WO WO 96/25590 8/1996

* cited by examiner

*Primary Examiner*—Shih-Yung Hsieh
(74) *Attorney, Agent, or Firm*—R W Becker & Associates; R W Becker

(57) ABSTRACT

An exhaust gas muffler is provided for an internal combustion engine, especially for two-stroke engines of manually guided implements such as power chain saws, brush cutters or the like. The muffler has a housing that includes two shells. One of the shells is provided with at least one outlet opening for exhaust gas. A cover is provided that guides the exhaust gas, and the cover has at least one discharge opening for the discharge of exhaust gas to the surrounding air. An exhaust gas chamber is formed within the cover. A screen element is disposed in the vicinity of the at least one discharge opening such that the exhaust gas stream is guided through the screen element.

21 Claims, 4 Drawing Sheets

EXHAUST GAS MUFFLER FOR INTERNAL COMBUSTION ENGINES

BACKGROUND OF THE INVENTION

The present invention relates to an exhaust gas muffler for internal combustion engines, especially for two-stoke engines of manually guided implements, such as power chain saws, brush cutters or the like. The muffler has a housing that includes at least two shells, wherein one of the shells is provided with at least one outlet opening for the exhaust gas, and whereby a cover is disposed over the at least one outlet opening for guiding the exhaust gas, with at least one discharge opening being provided in the cover for the discharge of the exhaust gas to the surrounding air.

WO 96/25590 discloses an exhaust gas muffler for an internal combustion engine in a portable implement. The exhaust gas muffler essentially comprises two shells that form a housing, with a partition extending between the shells. The partition divides the housing into two chambers, with the exhaust gas flowing out of the internal combustion engine into one of the chambers. Thereafter, the exhaust gas passes into the second chamber within the other shell, and from there the exhaust gas is guided through a tube to an outlet opening that is again disposed in the first shell. By means of this position of the outlet opening, the exhaust gas that exits the exhaust gas muffler is supposed to be mixed as intensively as possible with the cooling air stream of the internal combustion engine that is directed toward the exhaust gas muffler. This results not only in a rapid cooling of the exhaust gas stream, but also a cooling of the exhaust gas muffler, thereby reducing the temperature of the outer surfaces of the muffler. No measures are provided for preventing the discharge of sparks.

DE 25 39 516 A1 discloses an exhaust gas muffler for internal combustion engines for commercial agricultural and forestry implements. Since during operation of the implement the exhaust gas muffler gets very hot, this publication proposes that the wall of the exhaust gas muffler that contains the outlet opening be covered by a dish-shaped wall, with a cooling channel having a nozzle-like narrowed portioned being formed between the wall of the muffler and the covering wall. Adjoining this narrowed portion is a diffuser-like widened portion into which pass the exhaust gases that flow out of the outlet opening, whereupon they are mixed with the cooling air drawn in by the injector effect of the nozzle-like narrowed portion. Again with this arrangement, no measures are taken to prevent the discharge of glowing particles.

U.S. Pat. No. 4,370,855 describes an exhaust gas muffler for internal combustion engines in a manually guided implement, whereby a cover is secured to the outer side, i.e. the side remote from the internal combustion engine; the cover forms cooling channels between itself and the exhaust gas muffler. Disposed within the housing is a diffuser element that is surrounded by a screen that is intended to restrain particles carried along in the exhaust gas stream. The exhaust gas stream exits on that side of the exhaust gas muffler adjacent to the internal combustion engine, whereby the exhaust gas stream, via appropriate deflection, is supplied to the outer side of the exhaust gas muffler. In order to prevent the exhaust gas muffler from being overheated, it is necessary to direct the cooling air stream of the internal combustion engine against the exhaust gas muffler so that this cooling air stream reduces the temperature of the outer side of the muffler housing. With this known arrangement, the screen element must be made of high temperature resistant material since it is disposed in the immediate vicinity of the inlet opening through which the exhaust gases enter the exhaust gas muffler. Thus, the wires that form the screen cannot be as thin as would be desired, so that the mesh width of the screen element is also correspondingly large.

It is an object of the present invention to provide an exhaust gas muffler of the aforementioned general type whereby the discharge of particles along with the exhaust gas stream is significantly reduced.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 2:
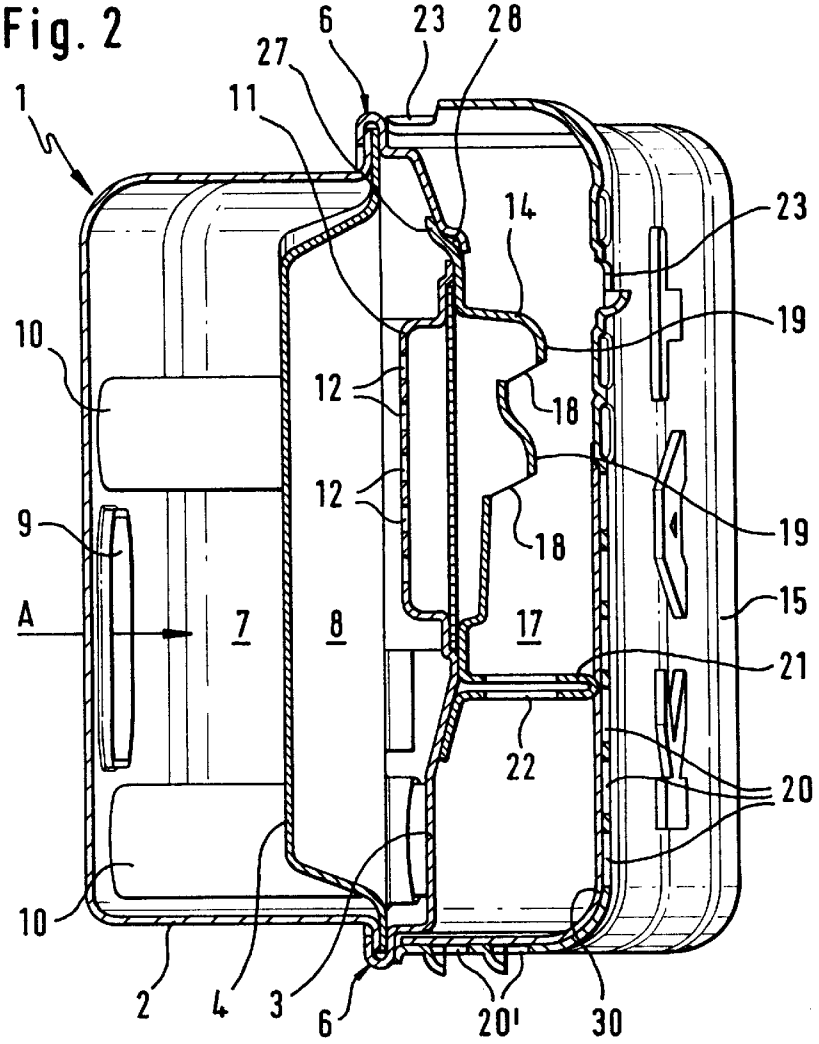
FIG. 2 is a cross-sectional view taken along the line II—II in FIG. 1.

The exhaust gas muffler of the present invention is characterized primarily in that an exhaust gas chamber is formed within the cover, and in the vicinity of the at least one discharge opening a screen element is disposed such that the exhaust gas stream is guided though the screen element.

During operation of the manually guided implement, the outer side of the cover has a lower temperature than does the housing that is formed from the shells, and the arrangement of the screen element in the immediate vicinity of the discharge opening prevents even small particles contained in the exhaust gas stream from being discharged; furthermore, not only during use but also when the engine is shut down dirt is prevented from passing through the discharge opening into the exhaust gas chamber. By embodying the cover as an extra shell, contact of the exhaust gas muffler itself is prevented; the temperature at the outer shell is significantly reduced, so that combustion or ignition of objects, such as branches or the like, is prevented. With regard to preventing fires, these measures therefore go beyond existing regulations.

Pursuant to one preferred specific embodiment of the present invention, the screen element can rest directly against the inner wall of the cover, so that the cover and the screen element form a common component. With such an embodiment, measures for supporting the screen element against the cover are not required. Pursuant to another embodiment of the invention, the screen element is disposed at a defined, preferably slight distance from the inner wall of the cover, whereby retaining means for supporting the screen element are provided on the inner wall of the cover. The retaining means can in a simple manner be formed by inwardly deformed wall sections of the cover. So that with a fine meshed screen element the resistance to flow for the exhaust gases is not too great, it is expedient to provide the screen element with as large a surface as possible and to provide a plurality of discharge openings. It is therefore expedient for the screen element to extend over at least half of the inner surface of the cover.

Pursuant to a preferred specific embodiment of the present invention, the cover is embodied as an outer shell that at least nearly entirely extends over the shell of the housing having the outlet opening. Since the shells of the housing of the exhaust gas muffler are customarily connected together by means of a flange connection, it is expedient to embody the outer shell in such a way that the rim thereof extends along the flange connection. In this manner, the housing of the exhaust gas muffler is entirely shielded on that side that is remote from the internal combustion engine. Securement of the outer shell to the housing of the exhaust gas muffler can be effected in various ways. For example, the rim of the outer shell can be at least partially formed in such a way that it extends over the flange rim of the housing in a form-fitting manner. Alternatively, holding clamps can be formed on the outer shell or can be placed thereon. In addition, it is possible to secure the outer shell with screws.

To the extent that due to installation conditions of the exhaust gas muffler in the portable implement portions of the housing of the muffler must be protected from contact, a shielding plate can be formed on the outer shell that preferably extends parallel to the contour of the muffler housing. To minimize production expenses, it is advantageous to make the outer shell as a single piece. So that the outer shell will have a great stability, and so that with the influence of force from the outside the volume of the exhaust gas chamber will not be too greatly reduced, a support element is provided in the exhaust gas chamber that extends between the shell of the housing and the outer shell. This support element is preferably embodied as a partition and has an aperture, so that the support element simultaneously serves as a flow distributor. Such a flow distributor is expedient if a plurality of discharge openings are distributed over the surface of the cover, so that rather than a concentrated exhaust gas stream, a more diffused exhaust gas stream is discharged into the surrounding air.

It is furthermore advantageous to provide in the cover at least one inlet opening for cooling air or surrounding air. As a consequence of the exhaust gas stream within the cover, there is generated in the exhaust gas chamber an injector effect via which air is drawn in through the inlet opening for mixing with the exhaust gas stream; this reduces the exhaust gas temperature at the discharge openings.

In addition to the screen element that is disposed within the cover, a spark extinction grid can be provided immediately adjacent to the outlet openings on the shell that forms the housing. Such a spark extinction grid can, for example, be formed by an appropriately dimensioned apertured plate, as a consequence of which the resistance to flow can be kept low. In order to impart to the exhaust gas stream in the exhaust gas chamber a defined direction of flow, it is expedient to form flow guiding elements on the outlet openings, or to provide a cap that extends over the outlet openings and is arched into the exhaust gas chamber; such a cap has apertures that lead into the exhaust gas chamber, whereby the apertures are delimited by flow guiding elements.

Further specific features of the present invention will be described in detail subsequently.

DESCRIPTION OF PREFERRED EMBODIMENTS

Figure 1:
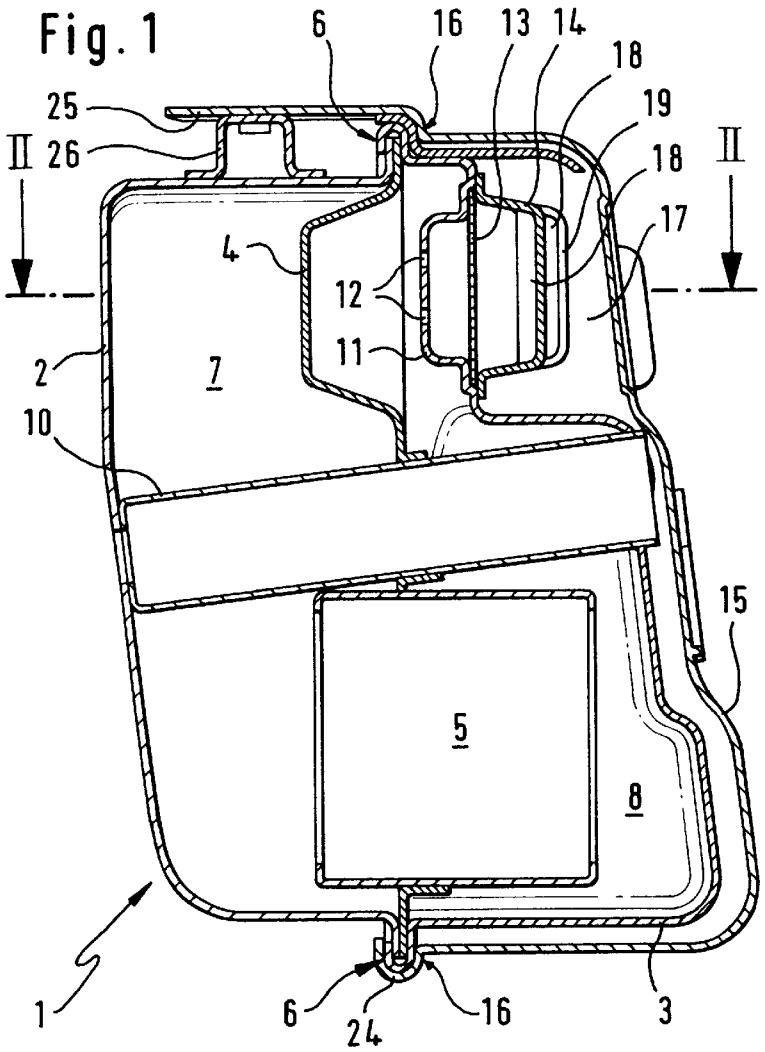
FIG. 1 is a longitudinal cross-sectional view through one exemplary embodiment of an inventive exhaust gas muffler.

Referring now to the drawings in detail, FIGS. 1 and 2 show an exhaust gas muffler 1, the housing of which is formed from two sections or shells 2 and 3, namely the inlet side shell 2 and the outlet side shell 3. Disposed within the gas exhaust muffler 1, between the shells 2 and 3, is a baffle or partition 4, the outer peripheral edge of which is clamped between the edges of the shells 2 and 3. Along with the interposition of the peripheral edge of the partition 4, the shells 2 and 3 are closed off to form a sealed housing by means of a flange connection 6. Disposed in the partition 4 is a catalytic converter 5, by means of which an inlet chamber 7, which is delimited by the partition 4 and the inlet side shell 2, is connected with an outlet chamber 8, which is delimited by the partition 4 and the outlet shell 3. The exhaust gas flows from the inlet chamber 7, through the catalytic converter 5, into the outlet chamber 8. Disposed in the shell 2 is an inlet opening 9 (see FIG. 2), by means of which the exhaust gas stream coming from the cylinder of the internal combustion engine in the direction of the arrow A passes into the inlet chamber 7.

Two tubular bodies 10, which are orthogonally oriented relative to the partition 4, extend through the inlet chamber 7 and the outlet chamber 8; due to the cross-sectional illustration in FIG. 1, only one of the tubular bodies 10 is visible therein. However, from FIG. 2 it can be seen that two tubular bodies 10 extend though the exhaust gas muffler 1. The outlet shell 3 is provided with an inwardly drawn recessed portion 11, which as can be seen in FIG. 2 has an elongated shape. Disposed in this recess 11 are a plurality of outlet openings 12 via which the exhaust gas leaves the outlet chamber 8. A spark extinction grid 13, which extends over the recessed portion 11, is inserted between the recessed portion 11 and a hood or cap 14 that extends over the recessed portion 11 with its outlet openings 12.

A cover 15, which is in the form of an outer shell, is disposed on the outer side of the shell 3. This outer shell 15 has a rim 16 that extends on the shell 3 along the flange connection 6. Formed between the outer shell 15 and the shell 3 is an exhaust gas chamber 17 into which the cap 14 is arched. Openings or apertures 18 are provided in the cap 14; these apertures are delimited by flow deflecting or guiding elements 19. In this manner, a main direction of flow is imparted to the exhaust gas stream upon entry thereof into the exhaust gas chamber 17. Disposed in the outer shell 15 are a plurality of discharge openings 20, 20', whereby the discharge openings 20 are provided in the region of the base of the outer shell 15, and the discharge openings 20' are provided on a side wall.

Disposed on the inner side of the cover 15, and resting against the inner wall, is a mesh or screen element 30 that extends over a large surface area and covers at least all of the discharge openings 20, 20'. In this way, the entire exhaust gas stream, regardless of through which discharge openings 20, 20' it exits the cover 15, is guided through the screen element 30.

Provided in the exhaust gas chamber 17 between the shell 3 and the outer shell or cover 15 is a support element 21 that is embodied as a partition having an aperture 22. Due to the magnitude of the aperture 22, the element 21 acts as a gas distributor, thus effecting as uniform a distribution as possible of the overall exhaust gas stream to the various discharge openings 20, 20'. In addition, provided in the outershell 15 are two inlet openings 23 through which surrounding air can flow into the exhaust gas chamber 17. As a consequence of the exhaust gas stream that enters the exhaust gas chamber 17 from the apertures 18, there results an ejector effect by means of which the surrounding air is drawn in through the inlet openings 23. This drawn-in air is mixed in the exhaust gas chamber 17 with the exhaust gas stream, thereby significantly reducing the temperature of the exhaust gas that is discharged from the openings 20, 20'.

As shown in FIG. 1, the rim 16 of the outer shell 15 is partially rounded, as indicated by the reference numeral 24, to form a groove by means of which the outer shell 15 extends about the flange connection 6 in a form-fitting manner. As is visible from the upper portion of FIG. 1, the outer shell 15 can be provided with a shielding plate 25 that is formed as an extension of the outer shell 15. This shielding plate 25 preferably extends parallel to the wall of the housing of the exhaust gas muffler 1, whereby this outer wall of the shell 2 is provided with a support element 26 against which the shielding plate 25 rests.

As can be seen from FIG. 2, the cap 14 and the support element 21 are made of a single piece, which is expedient with respect to reducing the number of individual parts and for facilitating assembly. Formed on the cap 14 is a projection 27 that can be inserted into an opening 28 in the shell 3. Formed on the other end of the cap 14 is the support element 21, which has a double-walled construction and via which those portions of the support element that are adjacent to the shell 3 rest thereagainst. Since the support element 21 is inserted between the inner side of the outer shell 15 and the shell 3, and in addition the projection 27 extends into the opening 28, not only the cap 14 but also the support element 21 are fixated.

Figure 3:
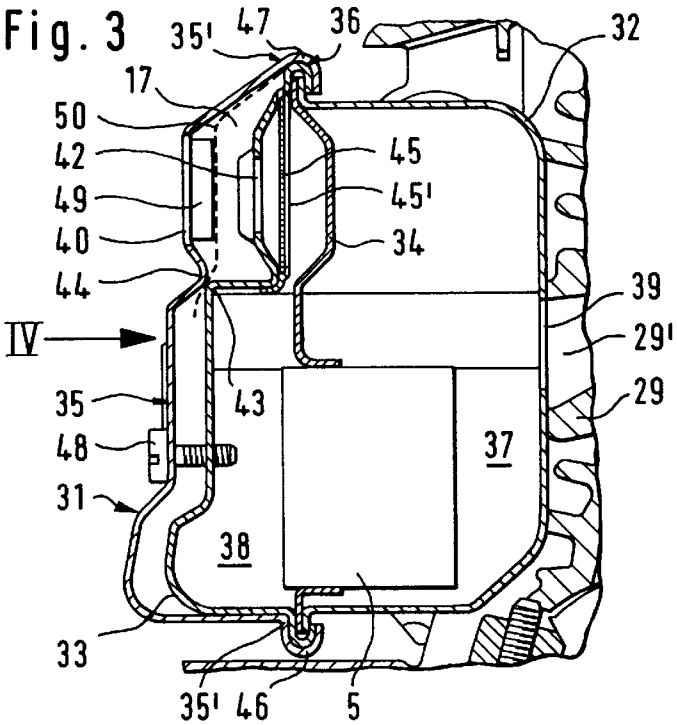
FIG. 3 is a longitudinal cross-sectional view through a modified embodiment of the muffler of FIG. 1.

FIG. 3 is a longitudinal cross-section through an exhaust gas muffler 31 that is mounted on an internal combustion engine 29 such that an inlet opening 39 of the muffler is aligned with an exhaust port 29' of the internal combustion engine. In a manner similar to that described in conjunction with the embodiment of FIG. 1, the exhaust gas muffler 31 comprises two shells 32, 33 and a partition 34 that is inserted between the shells and carries a catalytic converter 5. The two shells 32, 33 accompanied by the interposition of the peripheral edge of the partition 34, are joined together by means of a flange connection 36. An inlet chamber 37 and an outlet chamber 38 are formed in the exhaust gas muffler 31, whereby the exhaust gas can exit from the outlet chamber 38 through outlet openings 42 in a drawn portion 41 of the shell 33. Disposed on that side of the drawn portion 41 that faces the outlet chamber 38 is a spark extinction grid 45 that is secured to the shell 33 by means of a grid mount 45'.

A cover 35, which is embodied as an outer shell, extends over the shell 33. The peripheral rim 35' of the cover 35 rests against the shell 33, i.e. the flange connection 36. For this purpose, the outer shell or cover 35 has a rounded portion 46 at its rim 35' for accommodating the flange connection 36. Part of the rim 35' is in the shape of a hook 47 that can be brought over the flange connection 36 to span the same, as shown in FIG. 3. In this way, the outer shell 35 is secured to the housing that is formed of the shells 32, 33. The spark extinction grid 45 is disposed in a frame formed by the shell 33 and the grid mount 45' and, when the outer shell 35 is removed, can be withdrawn upwardly through a slot in the shell 33.

In the same manner as described in conjunction with the embodiment of FIG. 1, an exhaust gas chamber 17 is formed between the shell 33 and the cover 35. Disposed in the exhaust gas chamber 17 is a mesh or screen element 50 that extends in front of the discharge openings 40 that are provided in the outer shell 35. So that the screen element 50 maintains a defined yet slight spacing from the discharge openings 40, support elements 49 are provided against which the screen element rests. The screen element 50 is, on the one hand, secured to that portion of the rim 35' that is formed by the hook 47, and on the other hand is clamped between a shoulder 43 of the shell 33 and an inwardly directed deformation 44 of the outer shell 45. So that the tension between the shoulder 43 and the deformation 44, in other words the clamping effect for the screen element 50, is also maintained at the temperature changes that occur during operation, additional fastening screws 48 are provided by means of which an appropriate securing force is maintained in this abutment region.

Figure 4:
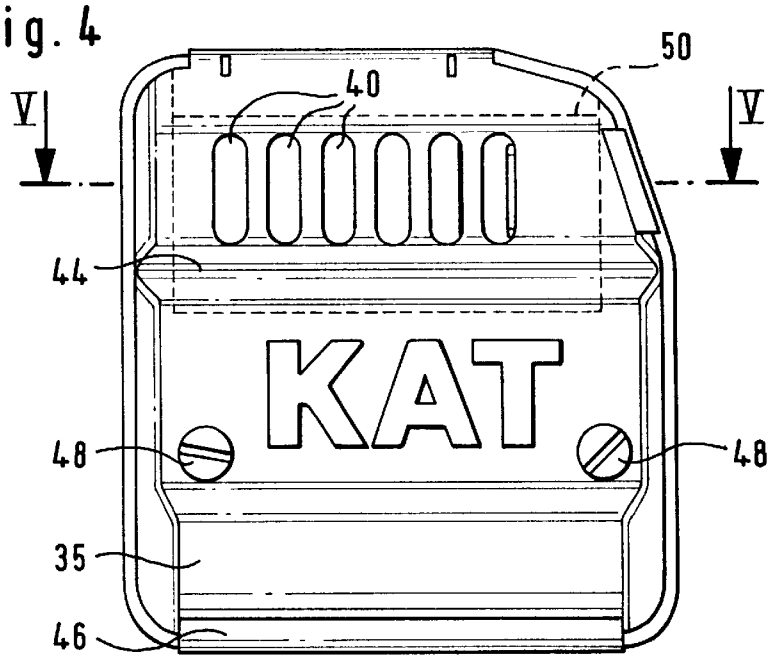
FIG. 4 is a view of the exhaust gas muffler of FIG. 3 taken in the direction of the arrow IV thereof.

FIG. 4 shows a view of the exhaust gas muffler 31 taken in the direction of the arrow IV in FIG. 3. As can be seen, the outer shell 35 is provided with a plurality of discharge openings 40 in the form of elongated slots. The reference numerals utilized in FIG. 4 correspond to those of FIG. 3 for the same parts.

Figure 5:
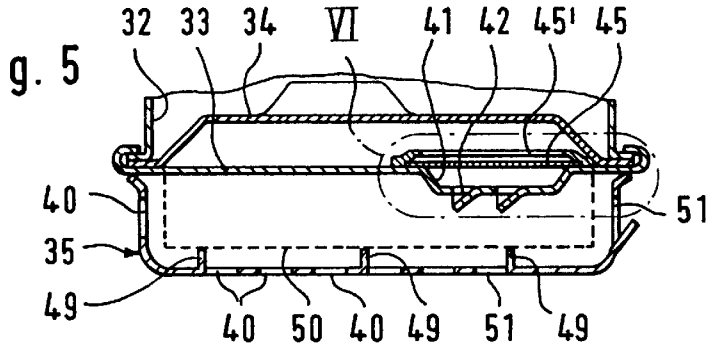
FIG. 5 is a partial cross-sectional view taken along the line V—V in FIG. 4.

FIG. 5 shows a partial cross-sectional view taken along the line V—V in FIG. 4. From this illustration it can be seen that the shape of the screen element 50 corresponds essentially to the contour of the outer shell 35 and that the two components have nearly uniform spacing over their entire length. In order to maintain this spacing, a plurality of the support elements 49 are provided that are expediently formed by inwardly deformed portions of the cover 35. These support elements 49 can extend, for example, up to 7 or 8 mm into the exhaust gas chamber 17. A plurality of discharge openings 40 are provided in the cover 35, and they can be disposed not only in the base portion of the outer shell 35, but also near the edge, as illustrated in the left side in FIG. 5. FIG. 5 also shows that two apertures 42 are provided in the drawn portion 41, whereby flow guiding elements are provided at the edges thereof for imparting a preferred direction of flow to the exhaust gas stream. On the right side in FIG. 5, inlet openings 51 are provided on the cover 35 and have a function that corresponds to that of the inlet openings 23 in FIG. 2. In other respects, the reference numerals in FIG. 5 correspond to those of FIGS. 3 and 4 for the same parts.

Figure 6:
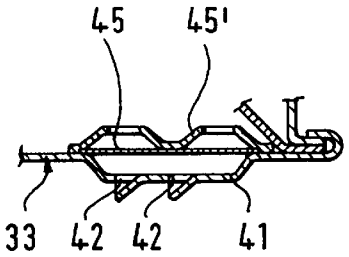
FIG. 6 is a modified embodiment of the portion VI in FIG. 5.

FIG. 6 shows a modification of the feature VI in FIG. 5. In this connection, the grid mount 45' is embodied as an apertured plate, whereby the central portion of this plate rests against the spark extinction grid 45 by means of an appropriate arched section. The number of holes of the grid mount 45' can be variable, so that the counter-pressure can be determined by the design of the grid mount 45'.

Figure 7:
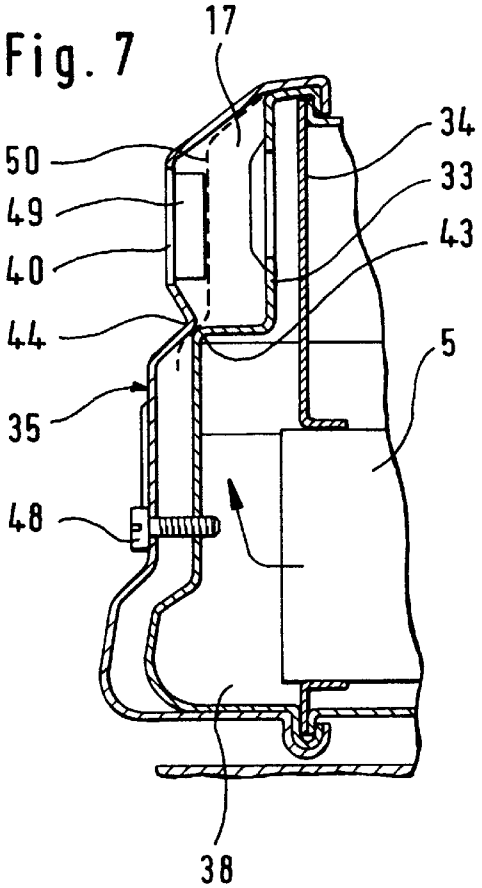
FIG. 7 shows a portion of a modified embodiment of the muffler of FIG. 3

FIG. 7 shows a portion of a modified embodiment of FIG. 3. With this arrangement, in contrast to FIG. 3, the portion of the shell 33 having the apertures 42 is planar, and no inner spark extinction grid is provided. Next to the apertures 42 the flow guiding element is raised, which in a straightforward manner is formed by a sheet metal strip that is bent out of the shell 33. With regard to all of the remaining features, with the exception of the concrete shape of the hook 47, all of the elements correspond with those of FIG. 3, so that in order to avoid repetition, reference is made to the description thereof.

Figure 8:
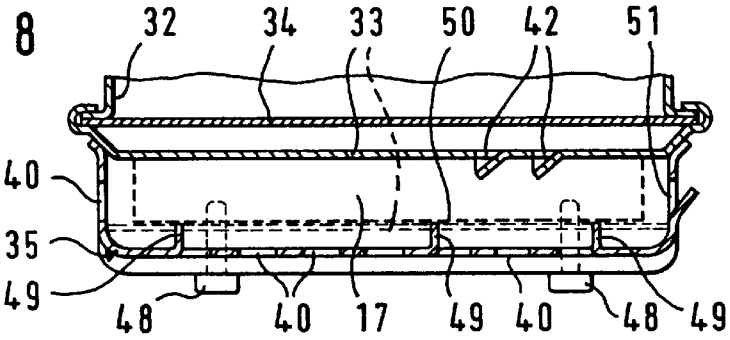
FIGS. 8–10 show various embodiments of the securement of an outer shell.
Figure 9:
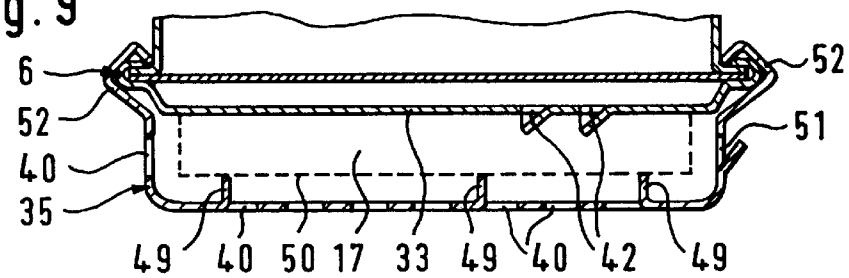
Figure 10:
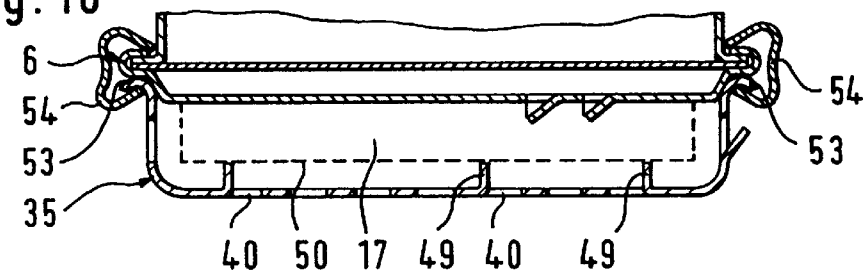

FIGS. 8, 9 and 10 illustrate various possibilities for securing the outer shell 35 to the housing of the exhaust gas muffler. For example, FIG. 8 shows the securement via screws 48 that extend through the outer shell 35 and are threaded into the shell 33. With such a fastening arrangement, the rim 35' of the outer shell 35 can have a very simple configuration since it needs to merely rest against the shell 33 and no form-fitting connection with the flange rim is required. FIG. 9 shows an embodiment where the outer shell 3 is provided on its peripheral rim 35' with clamps 52 that are formed thereon. These clamps 52 engage around the flange connection 36 and thus hold the outer shell 35 on the housing of the exhaust gas muffler. FIG. 10 shows an embodiment of the outer shell 35 that is provided with an outwardly flanged rim 53 that rests against the flange connection 36 of the two shells 32, 33 and is secured by clamps 54 that are placed thereon.

Figure 11:
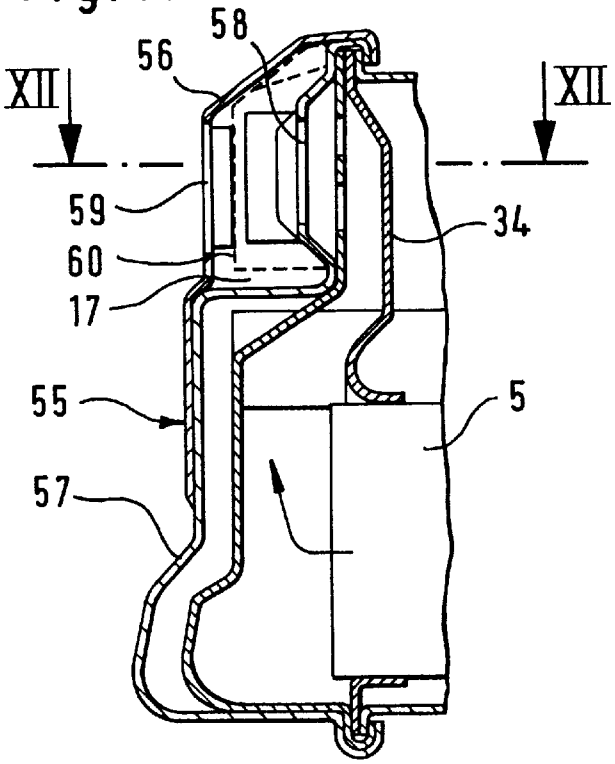
FIG. 11 shows a modified embodiment of the muffler of FIG. 7.

FIG. 11 shows a modified embodiment of FIG. 7, with the outlet openings 42 being formed in the shell 33 by stamped-out holes. An outer shell 55 is formed from two shell parts 56 and 57, with the exhaust gas chamber 17 being provided between these two shell parts. Disposed in the exhaust gas chamber 17 is a mesh or screen element 60 that extends over apertures 58 in the shell part 57, and that on the inner side of the shell part 56 covers all of the discharge openings 59.

Figure 12:
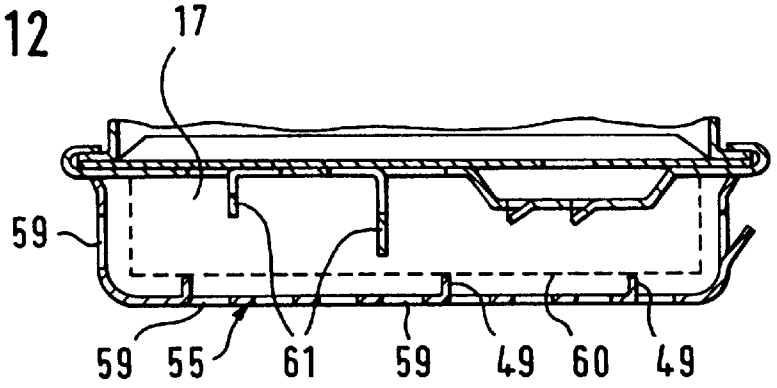
FIG. 12 is a cross-sectional view taken along the line XII—XII in FIG. 11.

FIG. 12 shows a cross-section taken along the line XII—XII in FIG. 11. Here it can be seen that when viewed in the longitudinal direction the screen element 60 has nearly the same shape as does the previously described screen element 50. Disposed within the exhaust gas chamber 17 are deflection plates 61 for uniformly supplying all of the discharge openings 59. In other respects, the reference numerals for the same parts correspond with those described in conjunction with FIG. 5.

Figure 13:
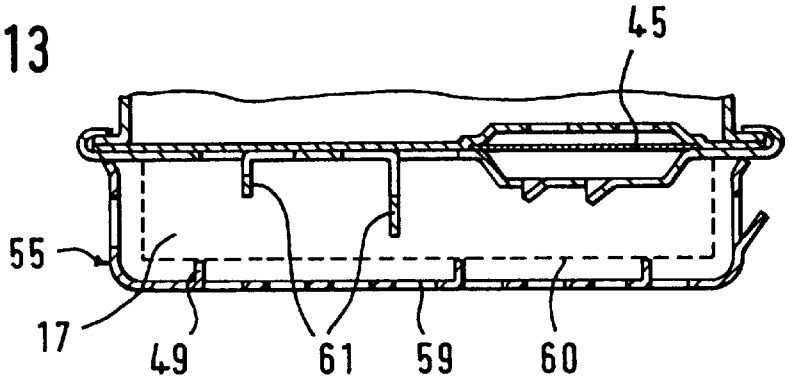
FIG. 13 is a modified embodiment of FIG. 12.

FIG. 13 illustrates a modified embodiment of FIG. 12, and differs from the already described embodiment in that a spark extinction grid 45 is disposed on the inner side, in other words, in a direction of flow upstream of the apertures 58.

The specification incorporates by reference the disclosure of German priority document 199 24 888.5 filed Jun. 1, 1999.

The present invention is, of course, in no way restricted to the specific disclosure of the specification and drawings, but also encompasses any modifications within the scope of the appended claims.

What we claim is:

1. An exhaust gas muffler for an internal combustion engine, especially for a two-stroke engine of a manually guided implement, said muffler comprising:

a housing that includes at least two shells, wherein one of said shells is provided with at least one outlet opening for exhaust gas;

a cover disposed over said at least one outlet opening for guiding said exhaust gas, wherein at least one discharge opening is provided in said cover for the discharge of said exhaust gas to surrounding air, wherein an exhaust gas chamber is formed within said cover, and wherein said cover is embodied as an outer shell that at least nearly completely extends over said one shell that is provided with said at least one outlet opening; and a screen element disposed in said cover in said vicinity of said at least one discharge opening thereof such that said exhaust gas is guided through said screen element.

2. An exhaust gas muffler according to claim 1, wherein said screen element 30 rests against an inner wall of said cover 15.

3. An exhaust gas muffler according to claim 1, wherein support elements are provided on an inner wall of said cover, and wherein said screen element is supported against said support elements.

4. An exhaust gas muffler according to claim 3, wherein said support elements are in the form of inwardly deformed sections of said cover.

5. An exhaust gas muffler according to claim 1, wherein said screen elements 30,50,60 extends over at least half of an inner surface of said covers 15,35,55 that delimits said exaust gas chamber 17.

6. An exhaust gas muffler according to claim 1, wherein said shells of said housing of said muffler are interconnected by means of a flange connection, and wherein a rim of said outershell extends along said flange connection.

7. An exhaust gas muffler according to claim 6, wherein said rim of said outer shell is at least partially deformed in such a way that it extends over said flange connection in a form-fitting manner, wherein holding clamps are formed on said rim of said outer shell.

8. An exhaust gas muffler according to claim 6, wherein screws are provided for securement of said outer shell.

9. An exhaust gas muffler according to claim 7, wherein said rim of said outer shell is at least partially radially outwardly flanged, and wherein said outer shell is secured to said flange connection of said housing by means of placed-upon clamps.

10. An exhaust gas muffler according to claim 1, wherein at least one shielding plate is formed on said outer shell and preferably extends parallel to a contour of said muffler housing.

11. An exhaust gas muffler according to claim 1, wherein said outer shell is a single piece.

12. An exhaust gas muffler according to claim 1, wherein a support element is provided in said exhaust gas chamber and extends between said one shell of said housing and said outer shell.

13. An exhaust gas muffler according to claim 12, wherein said support element is embodied as a partition having an aperture.

14. An exhaust gas muffler according to claim 12, wherein a cap is provided that is arched into said exhaust gas chamber and extends over said at least one outlet opening, wherein said cap is provided with apertures that lead into said exhaust gas chamber, and wherein flow guiding elements are provided that delimit said apertures.

15. An exhaust gas muffler according to claim 14, wherein said support element 21 and said hood 14 are embodied monolithically and are mechanically secured to said one shell 3.

16. An exhaust gas muffler according to claim 1, wherein a plurality of discharge openings are provided in said cover and are preferably distributed over a portion of the surface of said cover.

17. An exhaust gas muffler according to claim 1, wherein at least one inlet opening is provided in said cover.

18. An exhaust gas muffler according to claim 1, wherein a spark extinction grid is disposed on said one shell 3 that is provided with said at least one outlet opening 12.

19. An exhaust gas muffler according to claim 1, wherein a catalytic converter 5 is disposed in said muffler housing.

20. An exhaust gas muffler for an internal combustion engine, especially for a two-stroke engine of a manually guided implement, said muffler comprising:

a housing that includes at least two shells, wherein one of said shells is provided with at least one outlet opening for exhaust gas;

a cover disposed over said at least one outlet opening for guiding said exhaust gas, wherein at least one discharge opening is provided in said cover for the discharge of said exhaust gas to surrounding air, and wherein an exhaust gas chamber is formed within said cover, said cover having at least one inlet opening for entry of surrounding air into said exhaust gas chamber; and a screen element disposed in said cover in a vicinity of said at least one discharge opening thereof such that said exhaust gas is guided through said screen element.

21. An exhaust gas muffler according to claim 20, further comprising a spark extinction grid secured to one of said at least two shells by means of a grid mount.

* * * * *